United States Patent [19]

Laesch

[11] Patent Number: 4,457,646

[45] Date of Patent: Jul. 3, 1984

[54] IMPOUNDMENT AND DIVERSION SYSTEMS FOR PREVENTING OR MITIGATING FLOODING

[76] Inventor: Daniel A. Laesch, 212 Greenwood Ave., R.R. 7, Bloomington, Ill. 61701

[21] Appl. No.: 365,543

[22] Filed: Apr. 5, 1982

[51] Int. Cl.[3] ..... E02B 11/00

[52] U.S. Cl. ..... 405/52; 405/36

[58] Field of Search ..... 405/36, 1, 38, 43, 52, 405/53, 80, 118; 404/2, 4, 5, 17

[56] References Cited

U.S. PATENT DOCUMENTS

| | | | |
|---|---|---|---|
| 1,224,448 | 5/1917 | Davidson | 404/4 |
| 2,211,958 | 8/1940 | Mahaffey | 405/53 |
| 3,837,168 | 9/1974 | Alsberg et al. | 404/4 |
| 3,919,848 | 11/1975 | Sullivan | 405/43 |
| 3,996,741 | 12/1976 | Herberg | 405/53 |
| 4,045,909 | 9/1977 | Moss | 405/36 |

FOREIGN PATENT DOCUMENTS

| | | | |
|---|---|---|---|
| 507692 | 3/1976 | Bulgaria | 405/36 |
| 794111 | 1/1981 | Bulgaria | 405/36 |

*Primary Examiner*—Dennis L. Taylor

*Attorney, Agent, or Firm*—Kalish & Gilster

[57] ABSTRACT

A system for preventing or mitigating flooding is used in conjunction with an existing drainage facility such as a creek, sewer or the like, and includes one or more reservoirs, each of which is either an excavation or a subterranean chamber located proximate to the drainage facility. The reservoir is intended to impound water from the drainage facility. Diversion arrangements are employed for diverting water into the reservoir for temporary storage therein in response to abnormal volumetric water flow in the drainage facility, and for returning the temporarily stored water to the drainage facility upon return to normal volumetric flow therein. The diversion arrangements include various conduits between the reservoir and the drainage facility and, in the case of a creek, also include a wall constructed across the creek to limit the flow therein.

8 Claims, 10 Drawing Figures

IMPOUNDMENT AND DIVERSION SYSTEMS FOR PREVENTING OR MITIGATING FLOODING

BACKGROUND AND SUMMARY OF THE INVENTION

The present invention relates to flood control and, more particularly, to improved impoundment and diversion systems for preventing or mitigating flooding.

In many communities, the development of populated areas with consequent closely spaced housing units, large paved areas, such as the parking lots of shopping centers, numerous streets, and general lack of capability for the earth to absorb moisture has led to periodic flooding in times of heavy rainfall as well as during seasons of the year when watershed is considerable.

This problem has been further compounded in some areas because of the improper connection of roof drains to the sanitary sewer system. Therefore, when there is heavy rainfall, the runoff from roofs of buildings is added to the sometime marginal sewage drainage provided by an existing sanitary sewer system, some of which are quite antiquated and marginal at best. This has increasingly resulted in basement flooding, backing up of sewer drains and extensive damage, produced by flooding, to building substructures, foundations and basements.

Yet another problem has been the construction of residential units in areas intrinsically prone to flooding with consequent public attention being directed to the hapless residents who find themselves the victims of poor urban planning which has been compounded by an adequate storm and sanitary sewer drainage.

Such flooding, which has produced great economic loss and untold inconvenience and hardship in many parts of the country, is a product of our time. These problems are not concerned with merely one locality or even one type of drainage system, but rather effect diverse regional areas and cut across political, demographic and economic lines. Increasingly, they touch the lives, burden the pocketbooks and impose loss and hardship to persons of all class and status. Industry and business, in general, also feel the negative impact of these losses.

The efforts of man to control flooding are of ancient origin, dating back perhaps to individuals who first observed the successful work of beavers in damming streams. Thus, the use of dams across streams has been an old expedient, dating back to early civilization and used continuously ever since.

Modern communities in which there is substantial periodic flooding with loss of the foregoing character frequently visited upon the population are mute testimony to the fact that mankind has failed to cope always with the vicissitudes of nature and, as a consequence, society finds itself beset with the problem of flooding.

Analysis of the patents of prior efforts of others to solve these problems reveals the inadequacy of prior approaches. Thus, Butz U.S. Pat. No. 1,032,186 provides an early disclosure of a reservoir collection system in which water can drain into a reservoir to permit handling of a large quantity of the water when there is runoff of the same. This patentee contemplated that the water would be stored for later use, e.g., availability in dry weather.

Alsberg et al U.S. Pat. No. 3,837,168 discloses a drainage system for reducing flooding, the inventors having contemplated the recharging of underground water supplies through what amount to so-called connectors in the nature of wells. These permit the runoff water temporarily collected in storage channels to be routed into aquifers or other underground water sources, but this is inappropriate for most parts of the country and totally unsuitable where the need is to control flooding from sewers.

Stevenson U.S. Pat. No. 3,625,011 reveals a drainage system for artificial playing surfaces, which, of course, do not absorb water like conventional turf playing surfaces. Furman U.S. Pat. No. 4,247,220 may simply be noted as revealing that it has been known to utilize an underground reservoir for fluids, albeit liquid fuels.

None of these efforts of the prior art have produced a suitable answer to the needs presented by flooding problems of the type which are discussed above. These prior developments are not adequate for providing relief from the flooding which occurs because of the inadequacy of existing drainage facilities, whether such is a stream, canal, creek, culvert, sanitary sewer, storm sewer, or other conventional means for providing normal drainage of sewage or surface water.

It is an object of the present invention to provide impoundment and diversion systems for preventing or at least mitigating flooding which otherwise results from inadequate conventional drainage, and especially suitable for reducing the occurrence of local flooding along drainage facilities especially in areas where occasional conditions overtax existing drainage facilities.

It is a further object of the invention to provide such systems which provide temporary water storage to achieve effective flood relief in conjunction with various existing types of drainage facilities including streams, canals, creeks, culverts, sanitary sewers, storm sewers and various other conventional means for providing normal drainage of sewage or surface water.

It is also an object of the invention to provide such systems which permit existing drainage facilities to handle greater than normal surface water or sewage runoff as may occur due to heavy rainfall or may result from seasonal conditions resulting in heavy watershed and the like.

It is an object of the invention to provide such impoundment and diversion systems which can be utilized effectively in built-up and populated areas and which can provide effective relief from basement flooding and backing up of drains.

It is an object of the invention to provide such systems which can avoid the extensive damage, losses and difficulties which have resulted from flooding in relatively heavily populated urban areas when existing drainage facilities are inadequate to handle storm and sanitary sewer drainage which may result in occasional flooding.

A further object of the invention is to provide such impoundment and diversion systems which can be used in conjunction with existing drainage facilities without destroying the capability of using areas adjacent these existing drainage facilities for other purposes, and thereby maintaining the character and utility of such adjacent areas and avoiding disruption and dedication of otherwise useful areas.

It is also an object of the present invention to provide such impoundment and diversion systems which can be relatively economical, easily developed and constructed in various existing problem areas in many communities and which can be tailored to accommodate peculiar or unusual geographical or geological constraints often encountered in these areas.

Briefly, the invention contemplates various embodiments of a system for preventing or mitigating flooding. The system is used in conjunction with an existing drainage facility such as a creek, sewer or the like. More specifically, such a system comprises a reservoir, which may either be an excavation or, more preferably, a subterranean chamber, located proximate to the drainage facility. The reservoir is intended to impound water from the drainage facility. Diversion means is employed for diverting water to the reservoir for temporary storage therein in response to abnormal volumetric water flow in the drainage facility, and for returning the temporarily stored water to the drainage facility upon return to normal volumetric flow therein. The diversion means may include various conduits between the reservoir and the drainage facility and, in the case of a creek, also includes a wall constructed across the creek to limit the flow therein.

Other objects will be in part apparent and in part pointed out hereinbelow.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
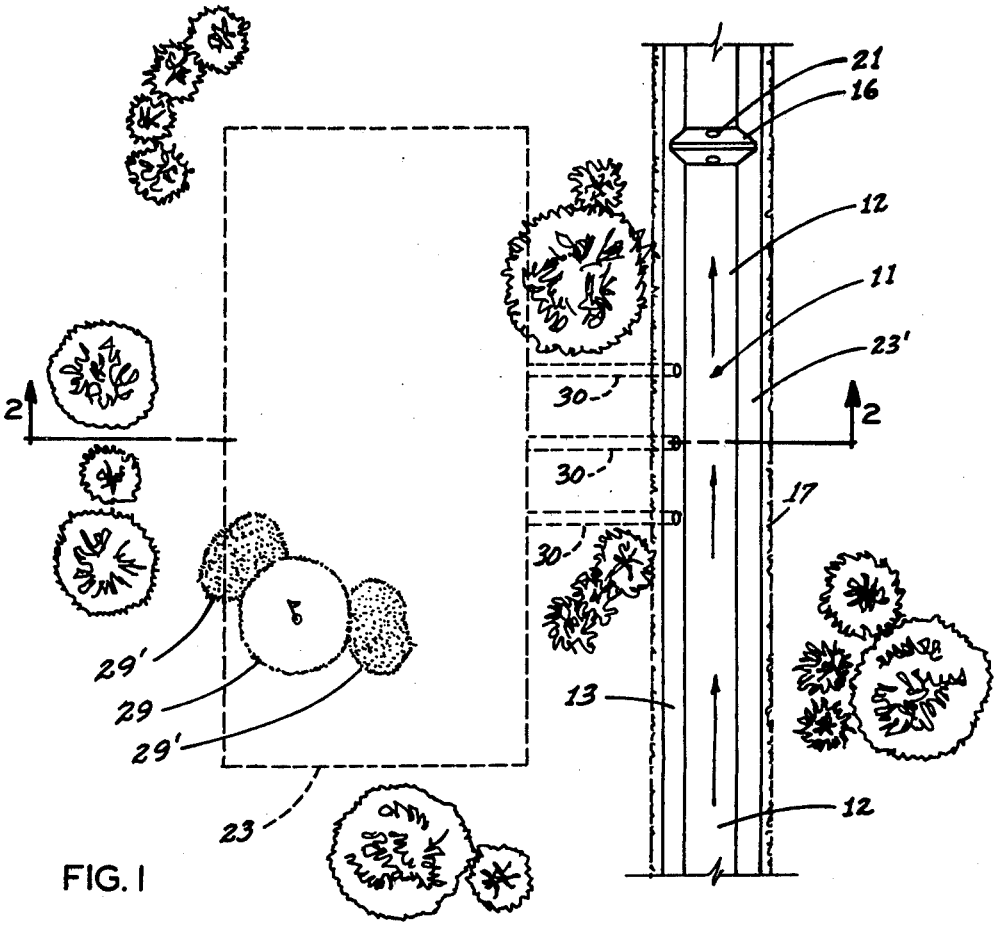
FIG. 1 is a horizontal plan view of a first embodiment of an impoundment and diversion system constructed in accordance with and embodying the present invention.
Figure 2:
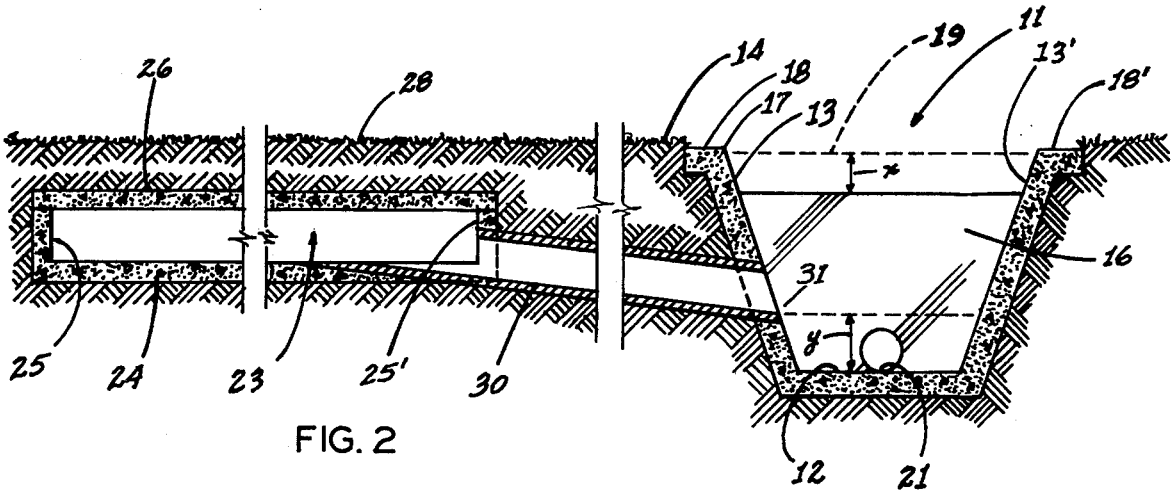
FIG. 2 is a vertical cross-section of the system of FIG. 1 as taken generally along line 2—2 thereof.

Referring to the drawings, and particularly to FIGS. 1 and 2, a first embodiment of an impoundment and diversion system of the invention is illustrated. This embodiment is utilized in conjunction with an existing drainage facility in the form of an open creek or channel generally designated at 11 typical of the kind used in various communities for providing drainage of surface water. In most urban communities, such a creek may typically be of an improved nature, having a concrete floor 12 and walls 13, 13′ for providing a facility prone to erosion or shifting. The term creek is intended to encompass any of various streams, rivers, canals, or other drainage ditches which are known and utilized for handling surface drainage, as distinct from sewage. Such a creek may meander or turn but merely for purposes of illustration, is shown in the drawings as being rectilinear. Also, for illustrative purposes only, ground level 14 is shown as being invariant and flat whereas in reality, it may be subject to be substantially irregular. For the present purpose, drainage creek 11 may be assumed to be in the direction of the arrows.

In accordance with this invention, a wall 16 is provided across the width of creek 11 between walls 13, 13′ and having depth less than creek 11 and having a level rectilinear upper edge 17 spaced a predetermined distance x below upper side edges 18, 18′ of creek walls 13, 13′, respectively, to define a headway of predetermined extent over the top upper edge 17 up to the level 19 which would represent the level of water in creek 11 if it were filled to its upper edges 18, 18′. Wall 16 may take various forms but, as illustrated, is of greater thickness at its bottom where it abuts floor 12 than at its upper edge 17.

Wall 16 is provided with at least one aperture 21 of circular section which extends through wall 16 to permit flow of water within creek 11. This aperture has its lower edge coincident with creek floor 12 so that wall 16 will not interfere with normal residual drainage in the creek nor cause pooling of water therein. However, since the cross sectional area of aperture 21 is much less than the cross section of the creek, heavy runoff in the creek will cause impoundment, or pooling, of water behind wall 16. If the water level exceeded edge 17, any additional rise is permitted to spill over the upper edge 17.

A large subterranean chamber 23 provides a reservoir which also forms a part of the system. The reservoir is formed representatively of concrete, which may be poured, precast or pretensioned, etc., to provide a floor 24 (which is slightly pitched toward creek 11), side walls as at 25, 25′ and a flat roof 26. Various supporting pillars or columns (not shown) may extend between floor 24 and roof 26 for providing additional strength and support. Reservoir 23 may be of various shapes but for illustrative purposes only is shown to be rectangular. Roof 26 may also be buried, having a layer 28 of earth over it to permit use of the land over reservoir 23 for conventional purposes. Here, a golf course having the usual putting green 29 and sand traps 29′ is illustrated to depict a type of use of the land above reservoir 23 which is made possible by the invention. Reservoir 23 can be of almost any shape and configuration, and it will be understood that the thickness of roof 26, walls 25, 25′ and indeed, floor 24, will be varied in accordance with the ultimate size, shape and general configuration of reservoir 23.

A plurality of subterranean conduits 30 interconnect reservoir 23 with creek 11. As shown in FIG. 2, each conduit slopes from the floor of reservoir 23 downwardly toward creek 11, opening into creek wall 13 at a point 31 spaced a distance y above creek floor 12 which may be the same or greater than the diameter of the opening 21 at the bottom of creek wall 16 so that the water normally flowing in creek 11 will not ordinarily enter conduits 30 and will instead flow through opening 21.

If there should be heavy rainfall or heavy runoff causing the water level to rise above opening 31, water is permitted to rise into reservoir 23 to provide relief for creek 11 for the purpose of mitigating flooding which otherwise could occur. Reservoir 23 is thus utilized to temporarily store the large amount of water which creek 11 is inadequate to handle. As the high water conditions subside and creek 11 continues to provide normal drainage, the water level eventually will fall below conduit openings 31 draining reservoir 23 by means of the creek. A typical flooding situation is that caused by heavy rain but this is a transitory condition which will not exceed the drainage capacity of creek 11 for more than a relatively short interval of time.

It is contemplated and preferred that a number of temporary storage facilities like reservoir 23 be constructed along creek 11, each reservoir being used in conjunction with the impoundment wall 16 in the manner illustrated to cause the temporary diversion of the excess runoff into the storage reservoir adjacent each creek wall.

Representative dimensions for reservoir 23 are width of 50 feet, length of 100 feet and height of several feet (but dependent upon the depth of creek 11). While reservoir size may vary according to the number of such reservoirs along the creek or other channel, each reservoir may hold several hundreds or millions of gallons of water.

The size of each reservoir 23 will, of course, be dependent also upon the size and shape of land adjacent the creek which is available for construction. Also, it is contemplated that there may be more than one wall 16 used in conjunction with a single reservoir. Therefore, a very long reservoir may be interconnected with creek 11 at various intervals along the length of the reservoir and the number of walls 16 being in accordance with the depth of the creek and its slope. In any event, the single or multiple reservoirs will store excessive flood water until the level in creek 11 subsides through normal runoff. The impoundment and diversion of water into each reservoir 23 is beneficial to locations downstream and so help to prevent a flooding downstream which otherwise would occur.

Figure 3:
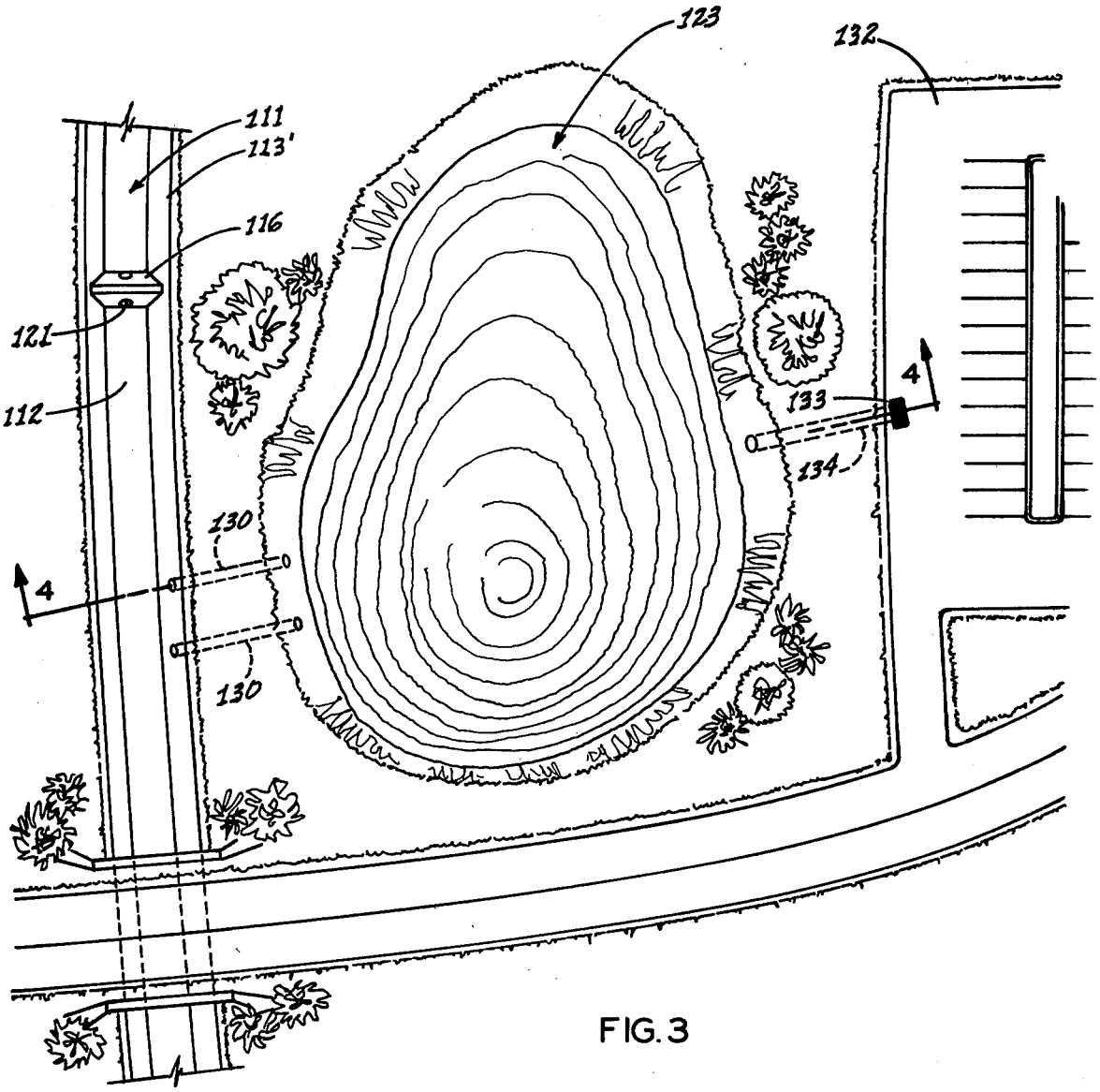
FIG. 3 is a plan view of a second impoundment and diversion system embodiment of my invention.
Figure 4:
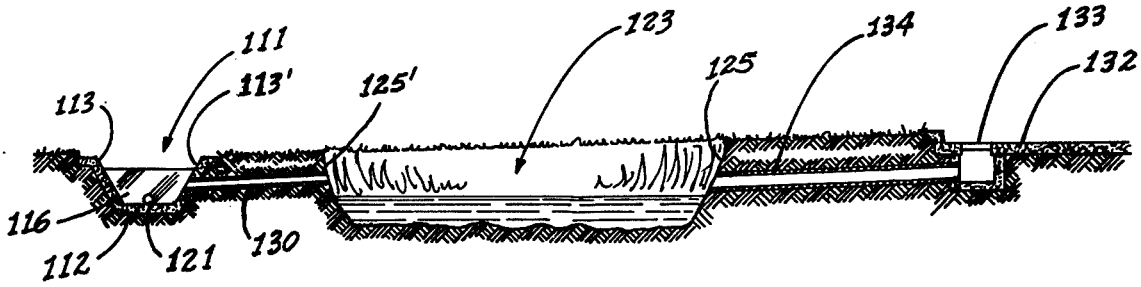
FIG. 4 is a vertical cross-section taken generally along line 4—4 of FIG. 3.

Referring to FIGS. 3 and 4, a second embodiment of the invention is used in conjunction with a similar creek 111, also shown as having a concrete floor 112 and sloping side walls 113, 113'. The creek is similarly provided with a wall 116 of dam-like configuration having a circular opening 121 longitudinally extending through the wall at the level of the floor of the creek. In accordance with the invention, a large pond-like excavation 123 serves as a reservoir for receiving water from creek 111 in the event of the water level rising in the creek. For this purpose, two conduits 130 provide communication between the wall 113' of the creek and the adjacent wall 125' of excavation 123. These conduits slope toward the creek from their points of connection to excavation 123 and open into creek wall 113 above the creek floor 112 in the same way as conduits 30 open into creek 11 of the embodiment of FIGS. 1 and 2.

Excavation 123 is shown as being of sufficient depth to provide for the presence at all times of some water, thereby creating in effect a pond or lake of aesthetic appeal which will, however, be capable of receiving a very substantial additional amount of water should the level of water in creek 111 rise sufficiently to permit flow from the creek through conduits 130 into the reservoir.

As further illustrated, the utility of the impoundment and diversion embodiment represented in FIGS. 3 and 4, there is shown at 132 a parking lot provided with a drain 133 at a location low enough for draining the lot. It is connected by a conduit 134 which opens at its opposite end into a wall 125 of excavation 123. Accordingly, a double purpose is served by the resultant reservoir 123. It not only receives excess water from creek 111 but also from area 132 (and is continually replenished in this way with the water therein being thus maintained at a proper level by receipt through conduit 134). Of course, should the runoff from area 132 be extreme, as in the case of a heavy rainfall, reservoir 123 will temporarily impound the heavy runoff and will be partially filled but with the discharge of water therefrom being limited through conduits 130. Conduit 134 is preferably dimensioned so that a greater flow rate into reservoir 123 results through conduits 134 than is drained through conduits 130. Under any condition causing water to rise and be impounded in creek 111, water is diverted through conduit. The impounded water will subsequently be discharged through conduits 130 through creek 111 as the water level subsides in the creek.

Figure 5:
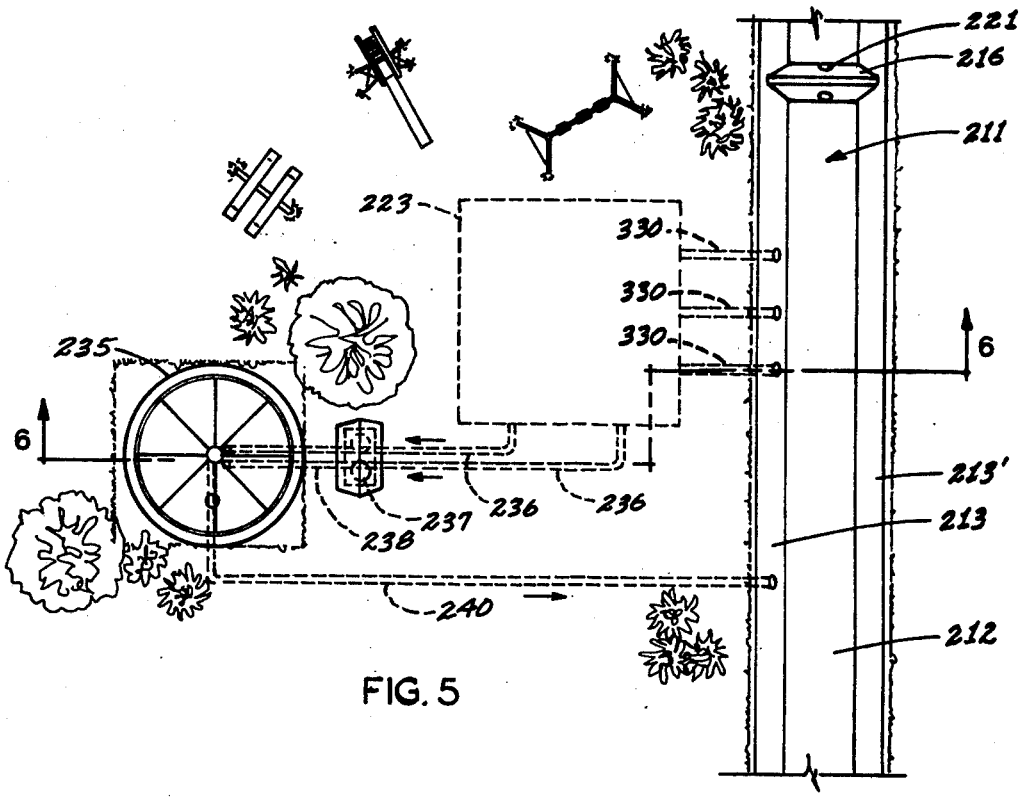
FIG. 5 is a plan view of a third impoundment and diversion system embodiment according to the invention.
Figure 6:
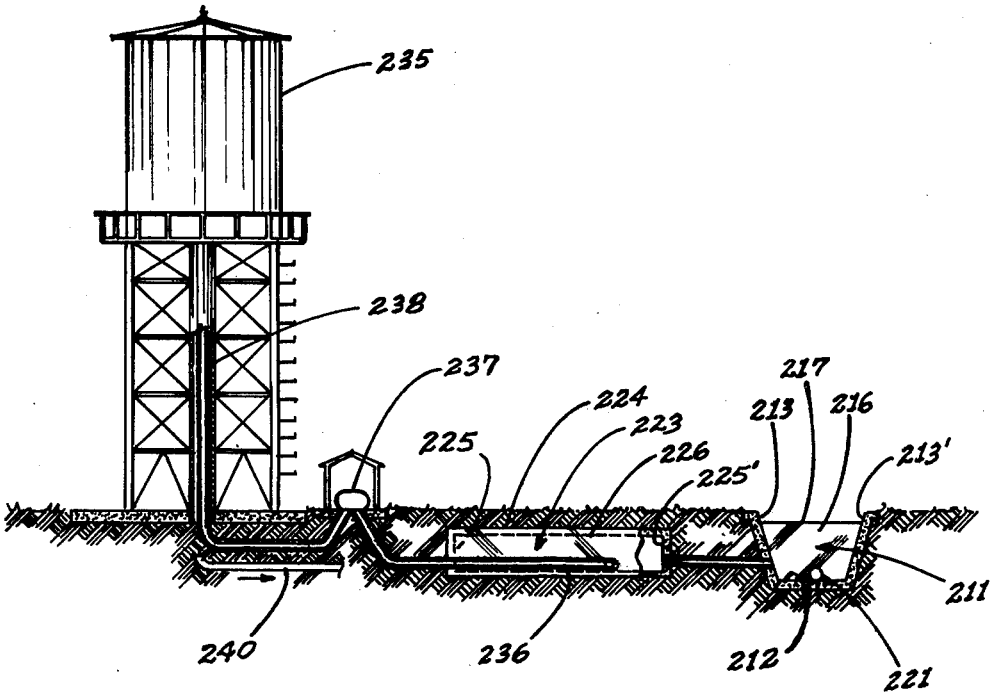
FIG. 6 is a vertical cross-section taken generally along line 6—6 of FIG. 5.

FIGS. 5 and 6 are demonstrative of a further embodiment of the new impoundment and diversion system. This embodiment is also demonstrated for use with a similar creek 211 having a floor 212 and sloping walls 213, 213'. A wall 216 is provided across the creek but terminating short of the upper edges of the side walls to provide headway for permitting the spilling over of water should the level rise above the wall upper edge 217. At least one opening 221 extends through wall 216 substantially coincident with the creek floor 212.

A subterranean chamber reservoir 223 having a concrete floor 224, side walls 225, 225' and roof 226 is provided adjacent to creek 211, there being three conduits 330 representatively interconnecting the reservoir with creek 211 according to the same general configuration shown in FIGS. 1 and 2. Reservoir 223, although illustrated as rectangular, may be of a different desired shape. Its dimensions are selected to provide capacity sufficient for the temporary receipt of water from creek 211 by flow through conduits 330 to mitigate flooding which otherwise would occur when creek 211 is incapable of handling flow which may result from heavy rainfall, etc. When the water reaches a certain level in reservoir 223, the pumps automatically begin pumping into tank 235.

Water from reservoir 223 is withdrawn through conduits 236, pumps 237 and pumped up into tank 235 through conduits 238. In this way, water can be drawn from reservoir 223 by auxiliary diversion and storage of the excess water in tank 235. The latter is merely representative of numerous possible forms of auxiliary reservoirs into which water can be pumped. More than one pump can be used to withdraw water from reservoir 223 and pump into tank 235 to provide faster flood relief.

A subterranean conduit 240 interconnects tank 235 with creek wall 213 and permits water to be selectively drained from tank 235 by opening a valve when conditions warrant the return of water to creek 211. Although only one tank 235 is shown, several such tanks may readily be employed to provide a storage capacity of millions of gallons of water.

Here again, the embodiments of FIGS. 5 and 6 permit the normal character of the land adjacent creek 211 to remain by employing a subterranean location for the principal reservoir 223. Thus, a playing field, building site, parking lot or other conventional use may be made of the land adjacent the creek.

Figure 7:
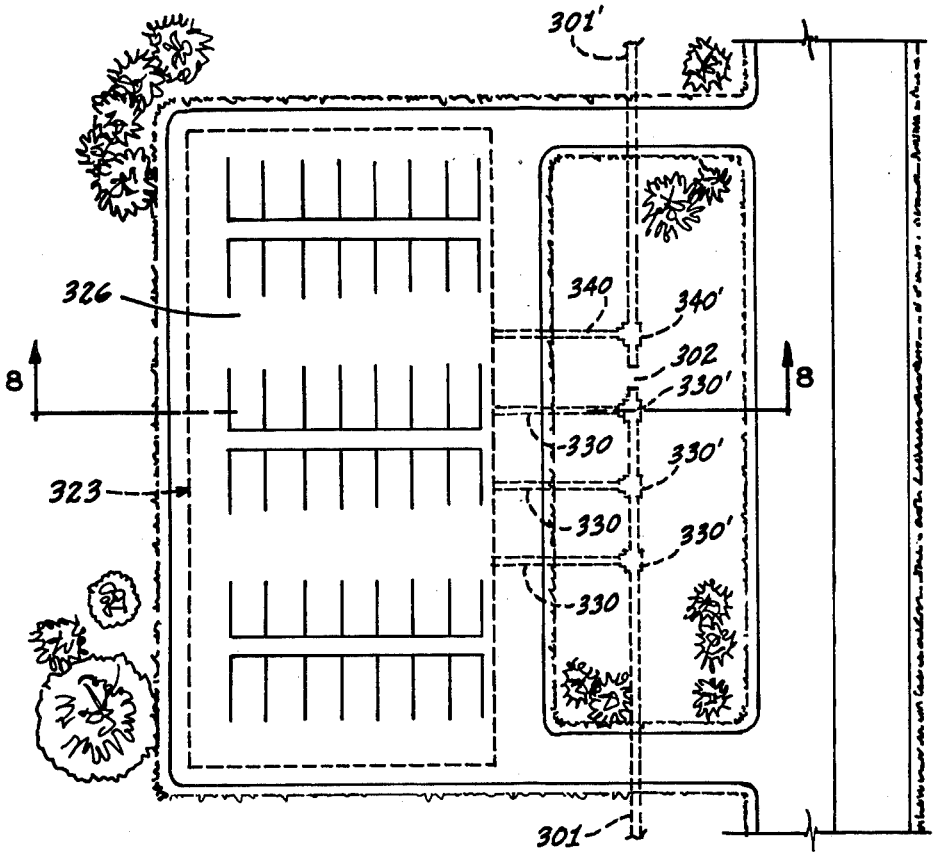
FIG. 7 is a plan view which illustrates yet another embodiment of an impoundment and diversion system of this invention of mine.
Figure 8:
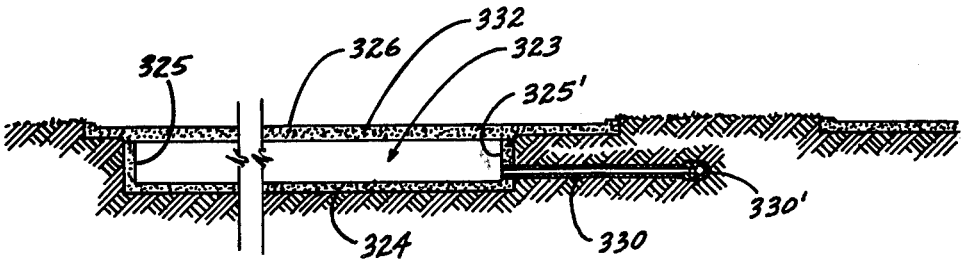
FIG. 8 is a vertical cross-section taken along line 8—8 of FIG. 7.

Referring now to FIGS. 7 and 8, an embodiment of the invention is illustrated which can be utilized to impound and divert the flow through a buried storm sewer 301. In accordance with the invention, line 301 is shown blocked at a location 302 whereby the discharge end of the line 301' is not connected directly to line 301. Rather, an indirect connection is made through a plurality of conduits 330 each of which is connected to line 301 by a respective tee 330' . These conduits provide communication to a subterranean reservoir 323. A further conduit 340 connects reservoir 323 with the discharge end 301' of line 301 by means of a tee 340'.

Reservoir 323, which extends along the lengthwise direction of sewer conduit 301 in spaced relation to it, and which may be of any of a variety of configurations and dimensions for achieving purposes of the invention, is here shown as representatively having a concrete floor 324 and side walls 325, 325' but provided with a roof 326 which serves also the purpose of providing a parking area 332. The reservoir size ultimately is determined by the volume of water it is desired to impound temporarily therein. The connecting conduits 330 thus interconnect reservoir 323 and line 301 at intervals along such lengthwise direction.

Thus, the construction of reservoir 323 achieves a dual purpose by making possible the ready preparation of a parking area. Various columns or supports within reservoir 323, although not shown, may be used to provide periodic support of the roof 326 across the length and width of the reservoir, as required if heavy loading of surface 326 is to be enabled.

The dimensions of conduits 330 and 340 are selected to permit rapid flow from line 301 of excess water into reservoir 323 for impoundment purposes but slower discharge through conduit 340. In this way, a condition of flooding in which the pressure in line 301 could build up (with consequent risk otherwise of basement flooding or backing up of drains, etc.) will instead cause diversion of the excess water into reservoir 323. Its size may be hundreds or millions of gallons as necessary to provide protection of line 301. Further, the sewer line may be provided with numerous such reservoirs along its length, as desired. In each case, subterranean location is preferably employed to permit the area above the reservoir to be used for conventional purposes, such as for parking, play ground, parks, etc.

Figure 9:
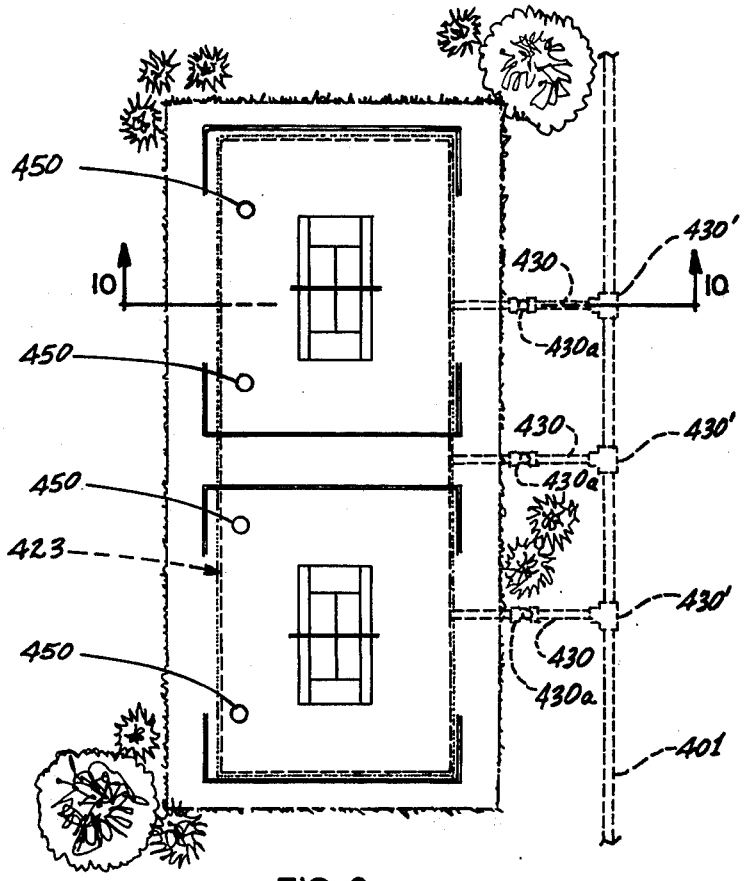
FIG. 9 is a plan view of yet another embodiment of an impoundment and diversion system of my invention.
Figure 10:
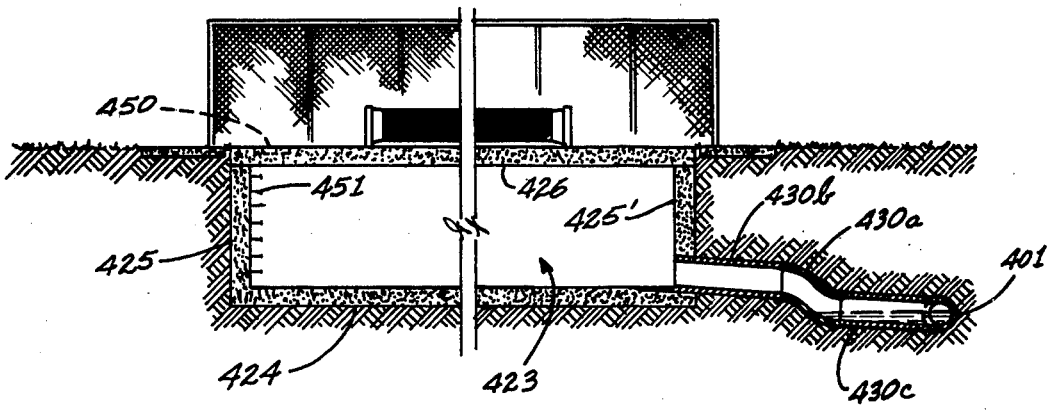
FIG. 10 is a cross-section of the system of FIG. 9 as taken generally along line 10—10 thereof.

Referring to FIGS. 9 and 10, an embodiment of the invention is illustrated which also makes possible the impoundment and diversion of excess flow in a sanitary sewer line 401. A large subterranean reservoir 423, laterally spaced from sewer line 401, is constructed with a concrete floor 424, side walls 425, 425', and a concrete roof 426 which is here illustrated as providing a surface for tennis courts. In accordance with the invention, multiple subterranean conduits 430 interconnect reservoir 423 with line 401. Referring to FIG. 10, each conduit 430 is provided with an offset portion **430*a*. This offset portion separates each conduit 430 into an upper portion 430*b* and lower portion 430*c*, the latter being connected by a respective tee 430' with line 401. Manifestly, as in all of the subterranean reservoir embodiments of the invention, the cross sectional dimensions of reservoir or chamber 423 are substantially far greater than those of the sewer line or conduit 401**.

Ordinarily, water will not rise above the offset **430*a* and into conduit portion 430*b*. Therefore, chamber 423 ordinarily does not receive water from line 401, assuming that the normal volumetric flow in line 401** does not produce any substantial back pressure.

However, in times of flooding, heavy rain, or other unusual conditions resulting in abnormally heavy volumetric flow, pressure build-up in line 401 resulting from a head of water higher than offset **430*a* will force water up into chamber 423, the volume of which will (as in previous embodiments) be selected to provide relief for the amount of water to be handled by line 401** into the system to which it is connected.

There may, of course, be numerous such chambers 423 along the length of line 401. The preferred subterranean construction allows the normal character of the adjacent property to be preserved. In this embodiment, roof 426 of the chamber provides tennis courts but, of course, this is merely representative of various usages permitted by the invention.

Since line 401 may be expected to carry solids and sludge, it is preferred ordinarily to prevent these solids from entering chamber 423 and such is effectively accomplished by the offset portion **430*a*, as the water level typically does not rise (except in abnormal conditions). To provide the capability of cleaning out chamber 423 should there be some sludge or solids remaining therein after a number of instances of sufficent rise of the water level to partially or completely fill the chamber, there are provided removable covers 450 which covers open into roof 426. Ladder rungs 451 adjacent each such cover allow worker access to chamber 423**.

In this embodiment, multiple conduits 430 are preferred to allow quick relief from the high pressure which otherwise might develop in line 401 and, thus, to quickly divert water into chamber 423 so as to prevent still higher pressure downstream which could have the effect of forcing water up into drains and otherwise producing flooding or other damage as is all too typical in many communities.

The offset conduit arrangement of FIGS. 9 and 10 may also be used in conjunction with other drainage facilities, whether such be a creek, storm sewer, or other channel. But, when used with a so-called sanitary sewer line, the floor of chamber 423 and conduit portion **430*b* are located above the sewer line, and together with offset 430*a*, prevent water from entering chamber 423** from the sewer line when there is normal volumetric flow in the sewer line.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A system for preventing or mitigating flooding for use in conjunction with an existing drainage facility including an existing subterranean sewer conduit adequate for normal volumetric water drainage flow but subject to abnormal volumetric water flow therein, said system comprising a subterranean chamber located proximate to said drainage facility but laterally displaced from said drainage facility for impounding water from said sewer conduit, and diversion means constituted by the addition of at least one subterranean conduit interconnected with said sewer conduit for receiving water from said sewer conduit only in the event of abnormal flow in said sewer conduit for diverting water from said sewer conduit into said subterranean chamber for temporary storage therein response to abnormal volumetric water flow in said sewer conduit and for returning the temporarily stored water from said reservoir to said sewer conduit upon return to normal volumetric flow in said sewer conduit, said subterranean chamber having a floor higher than the water level defined by said sewer conduit during normal drainage flow therein, thereby preventing water normally from entering said subterranean chamber from said sewer conduit during such normal volumetric flow, said subterranean chamber having cross sectional dimensions substantially far greater than those of said sewer conduit for permitting entry of water into said subterranean chamber for temporary impoundment therein by lateral diversion of a substantial volume of water from said sewer conduit facility only upon rise of water level resulting from abnormal volumetric flow in said sewer conduit, said temporary impoundment preventing or mitigating flooding which otherwise may result from the incapability of said sewer conduit to handle said abnormal volumetric water flow.

2. A system for preventing or mitigating flooding for use in conjunction with an existing drainage facility such as a creek, sewer or the like, said system comprising a subterranean chamber proximate to said drainage facility for impounding water from said drainage facility, and diversion means for diverting water into said chamber for temporary storage therein in response to abnormal volumetric water flow in said drainage facility and for returning the temporarily stored water from said chamber to said drainage facility upon return to normal volumetric flow in said drainage facility, at least one conduit interconnecting said drainage facility with said chamber, said chamber and conduit being oriented relative to said drainage facility for receiving water therefrom only in the event of abnormal flow in said drainage facility, and at least one further reservoir separate from said chamber and located thereabove, a further conduit interconnecting said chamber with said further reservoir, means for pumping water through said further conduit to transfer water from said chamber to said further reservoir, and a still further conduit for permitting selective draining of water from said further reservoir to said drainage facility.

3. A system for preventing or mitigating flooding according to claim 2 and further characterized by said drainage facility being constituted by a creek.

4. A system for preventing and mitigating flooding for use in conjunction with an existing drainage facility constituted by a creek, said system comprising a reservoir proximate to said drainage facility for impounding water from said drainage facility, and diversion means for diverting water into said reservoir for temporary storage therein in response to abnormal volumetric water flow in said drainage facility and for returning the temporarily stored water from said reservoir to said drainage facility upon return to normal volumetric flow in said drainage facility, said diversion means including at least one wall extending transversely across said creek, said wall being provided with an aperture therethrough permitting limited normal flow of water therethrough but causing damming of water behind said wall in the event of abnormal volumetric flow in said creek, said diversion means further including a communication between said creek and said chamber upstream of said wall for permitting water dammed behand said wall to flow temporarily into said chamber.

5. A system for preventing and mitigating flooding according to claim 4 and further characterized by said wall being of height less than the depth of said creek to provide a headspace above said wall over which water may spill if water depth in said creek exceeds said wall height.

6. A system for preventing or mitigating flooding, for use in conjunction with an existing drainage facility constitued by a creek, said system comprising a reservoir proximate to said drainage facility for impounding water from said drainage facility, and diversion means for diverting water into said reservoir for temporary storage therein in response to abnormal volumetric water flow in said drainage facility and for returning the temporarily stored water from said reservoir to said drainage facility upon return to normal volumetric flow in said drainage facility, said diversion means including at least one wall extending transversely across said creek, said wall being provided for an aperture longitudinally therethrough permitting limited normal flow through said aperture but causing damming of water behind said wall in the event of abnormal volumetric flow in said creek, said conduit means providing for flow of water from said creek into said excavation upon the level of the water dammed behind said wall rising above a normal level thereby temporarily adding to the water level in said excavation.

7. A system for preventing or mitigating flooding according to claim 6 and further characterized by drain means for draining an area of surface water, and conduit means interconnecting said drain means with said excavation, whereby water on said surface is drained into said excavation.

8. A system for preventing or mitigating flooding according to claim 1 and further characterized by said sewer conduit and said subterranean chamber each extending in a lengthwise direction in side-by-side, spaced relationship, said subterranean conduit being one of a plurality of such subterranean conduits interconnecting said sewer conduit and said subterranean chamber at intervals over said lengthwise direction.

* * * * *